US005129513A

United States Patent [19]

David et al.

[11] Patent Number: 5,129,513

[45] Date of Patent: Jul. 14, 1992

[54] CIGARETTE PACKS WITH RETENTION CUTS TO FACILITATE CONSISTENT LID CLOSURE

[75] Inventors: Wallace M. David, Richmond; Duane C. Wilder, Chesterfield, both of Va.

[73] Assignee: Philip Morris Incorporated, New York, N.Y.

[21] Appl. No.: 796,350

[22] Filed: Nov. 22, 1991

[51] Int. Cl.[5] ..... B65D 5/66

[52] U.S. Cl. ..... 206/265; 206/271; 206/146

[58] Field of Search ..... 206/264, 265, 266, 268, 206/271, 273; 229/160.1, 146

[56] References Cited

U.S. PATENT DOCUMENTS

| | | | |
|---|---|---|---|
| 2,085,458 | 6/1937 | Walker . | |
| 2,247,870 | 7/1941 | Chalmers | 229/160.1 |
| 2,796,212 | 6/1957 | Graybill | 229/146 X |
| 2,848,153 | 8/1958 | Geiger, Sr. . | |
| 3,058,646 | 10/1962 | Guyer | 229/160.1 |
| 3,079,064 | 2/1963 | Ringler | 229/160.1 |
| 3,099,382 | 7/1963 | Talbert | 229/160.1 |
| 3,438,564 | 4/1969 | Moreton . | |
| 3,490,679 | 1/1970 | Heller et al. . | |
| 3,858,788 | 1/1975 | Phillips, Jr. . | |
| 4,267,958 | 5/1981 | Focke et al. | 229/146 |
| 4,466,536 | 8/1984 | Zeitel | 206/273 |
| 4,729,508 | 3/1988 | Erdmann et al. | 229/146 |
| 4,753,383 | 6/1988 | Focke et al. | 229/160.1 |
| 4,753,384 | 6/1988 | Focke et al. | 229/160.1 |
| 4,852,734 | 8/1989 | Allen et al. | 206/273 |
| 5,044,550 | 9/1991 | Lamm | 229/160.1 |

*Primary Examiner*—Paul T. Sewell
*Assistant Examiner*—Jacob K. Ackun, Jr.
*Attorney, Agent, or Firm*—Karen G. Horowitz

[57] ABSTRACT

A box-like cigarette pack having tab-like retention members formed in the walls of one of the innerframe and lid. The retention members function to help keep the lid completely closed by producing interference between the lid and the innerframe. The retention members are formed with cuts made at an angle to the plane of the wall in which they are formed. These cuts form pointed edges which are on opposite faces of the wall. Once the retention member is pushed out of the plane of the wall, the pointed edge of the surrounding wall retains the retention member outside the plane of the wall.

13 Claims, 2 Drawing Sheets

CIGARETTE PACKS WITH RETENTION CUTS TO FACILITATE CONSISTENT LID CLOSURE

BACKGROUND OF THE INVENTION

This invention relates to cigarette packs, and more particularly to cigarette packs in the form of boxes which may, for example, have radiused vertical edges.

Cigarette packs in the form of boxes are extremely well known. One of the most popular forms of such boxes has an outer member which includes a lower main portion in which the cigarettes stand vertically. The upper portion is a lid which is often (although not always) hinged to the back of the main portion so that the upper ends of the cigarettes are exposed when the lid is tipped back. Such boxes typically have an innerframe inside the main portion and which extends up from the main portion under the lid as it opens and closes. Although such boxes are standardly formed with right angled vertical edges, the vertical edges may be rounded/radiused.

One important function of the innerframe is to provide some interference with the lid as it opens and closes. This interference helps to keep the lid firmly and neatly closed and reduces the risk that the lid will open accidentally. However, the innerframe provides such interference mainly once the lid is beginning to open beyond a certain amount. The innerframe does not always provide interference initially. Hence the lid may not always remain completely closed with the bottom edges of the lid resting directly on the top edges of the outer member lower main portion of the box. It is desirable for the lid to remain completely closed for the sake of appearance and neatness (e.g., so that any loose tobacco remains within the box).

The provision of retention means which retain the lid in a completely closed position has previously been accomplished through use of means such as a tab member extending substantially perpendicular to the plane of a wall of the innerframe, thereby interfering with the lid member. Such a tab member is generally formed from the standard innerframe blank such that when the tab is extended perpendicular to a wall, a cutout area remains where the tab originally had been. Furthermore, such retention means are generally formed at the front right-angled vertical edges of the innerframe. In the case of a box with rounded/radiused vertical edges, the vertical edges are rounded/radiused by multiple scoring of the blank, and the additional formation of such retention means may be difficult or impossible.

It is therefore an object of this invention to provide a retention means which retains the lid in completely closed position on a cigarette box.

It is another object of this invention to provide a retention means formed from a standard blank, i.e., which does not require a deviation from the standard shape of a blank, yet does not leave a cutout area once it is moved into retaining position away from the plane of the blank from which it is formed.

It is yet another object of this invention to provide a retention means which is formed within the boundaries of the walls of an innerframe instead of along the vertical edges of an innerframe to facilitate formation of such retention members on boxes with rounded/radiused vertical edges.

SUMMARY OF THE INVENTION

These and other objects of the invention are accomplished in accordance with the principles of the invention by cutting (e.g., with a die cut) a preferably cardboard or paperboard blank for a cigarette box, preferably an innerframe blank, at an angle to the plane of the blank to form at least one and preferably two tab-like retention members. The retention members are preferably formed in portions of the blank which will form the side walls of the box when the blank is folded. Because the blank in which the retention cuts are formed will eventually be formed into a box, the blank and hence the retention member each have a predetermined inner surface which will eventually face the interior of the box, and a predetermined outer surface which will eventually face outwardly from the box. In the preferred embodiment, each retention cut forms an obtuse angle with the plane of the outer surface of the retention member (i.e., the face which will eventually face outwardly from the box and come in contact with the lid member), and consequently forms an acute angle with the plane of the inner surface of the retention member.

As a result of the retention cuts being made at an angle, the edges of the retention members have substantially pointed edges, and the edges of the remaining blank from which the retention members are cut have similarly substantially pointed edges. This configuration is important in effecting the desired position of the retention members against the plane of the blank such that a cutout portion does not remain. This is accomplished as follows. Since the retention cuts are made at an angle, the pointed edges are initially at opposite surfaces of the blank. The pointed portion of each retention member's edge (which is along the inner surface of the blank) is pushed outwardly beyond the pointed edges of the remaining portion of the blank (which is along the outer surface of the blank) in order to lie against the outer surface of the blank. In this manner, the pointed edges of the blank hold the retention members in a plane substantially parallel to and outward of the plane of the outer surface of the blank, such that the retention members cannot readily return to their initial flush position with the blank. The position of the retention members in such a plane provides the desired additional interference with the lid member.

As an alternative to forming the above-described retention member on the innerframe so that it contacts the lid, the retention member could be formed on the lid so that it contacts the innerframe.

Further features of the invention, its nature and various advantages will be more apparent from the accompanying drawings and the following detailed description of the preferred embodiments, wherein like numerals represent like elements.

DETAILED DESCRIPTION OF THE PREFERRED EMBODIMENTS

Figure 1:
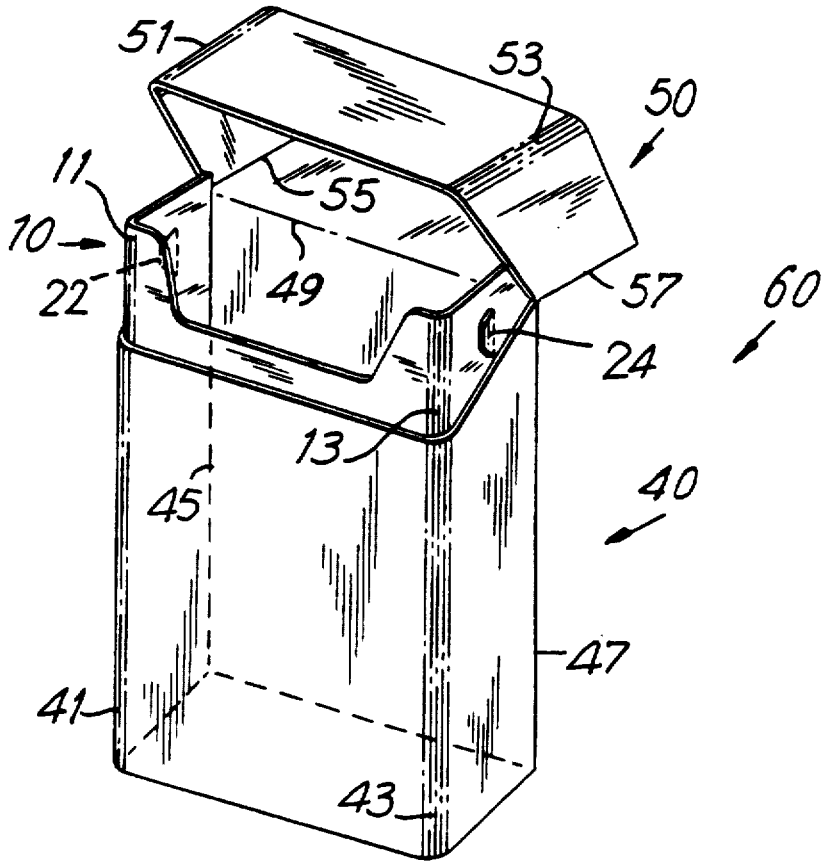
FIG. 1 is an isometric view of a cigarette pack with the top or lid pivoted back, having retention members in accordance with this invention.

A cigarette pack 60 having retention means 22 and 24 in accordance with this invention is generally shown in FIG. 1. Cigarette pack 60 includes an outer member lower main portion 40, an outer member lid 50, and an innerframe 10, all of conventional cardboard (e.g., .012 inch thick cardboard). Lid 50 is typically hinged along hinge line 49 to outer member lower main portion 40. Innerframe 10 is attached (e.g., with glue) to the inside of lower main portion 40, and extends at least partially above the top of lower main portion 40. When lid 50 is closed, it fits down over and completely covers the portion of innerframe 10 which projects above lower main portion 40. Innerframe 10 is a structural member which interferes somewhat with lid 50 as the lid is opened and closed. This interference reduces the risk of the pack opening by accident. Retention members 22 and 24 provide additional pressure to the inside of lid 50 to keep the lid firmly closed and resting on the top of the lower main portion 40, hence keeping the lid from even beginning to open accidentally. In the preferred embodiment, vertical edges 11, 13, 41, 43, 45, 47, 51, 53, 55, and 57 are rounded/radiused, preferably by multiple parallel scoring of the blank. The radius of curvature of each of these edges may be approximately 5/32 inches.

Figure 2:
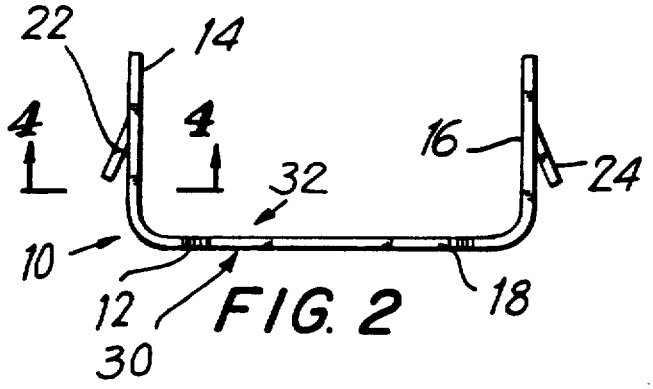
FIG. 2 is a top view of an innerframe in accordance with this invention.

An illustrative innerframe 10 in accordance with this invention is shown in FIG. 2. Innerframe 10 includes a front wall panel 12, a left side wall panel 14, and a right side wall panel 16. The outer surface 30 of the innerframe 10 faces outwardly from the innerframe such that it will come in contact with the inside of the lid member 50 when the lid is closed. The inner surface 32 of the innerframe 10 faces the inside of the pack such that it will be adjacent the cigarettes in the pack. Tab-like retention members 22 and 24 extend beyond the plane of the outer surfaces 30 of, preferably, the side walls 14 and 16, respectively, to apply additional pressure to or frictional engagement of each side of lid 50, thus keeping the lid relatively tightly closed on the pack so that it will not begin to open accidentally.

Figure 3:
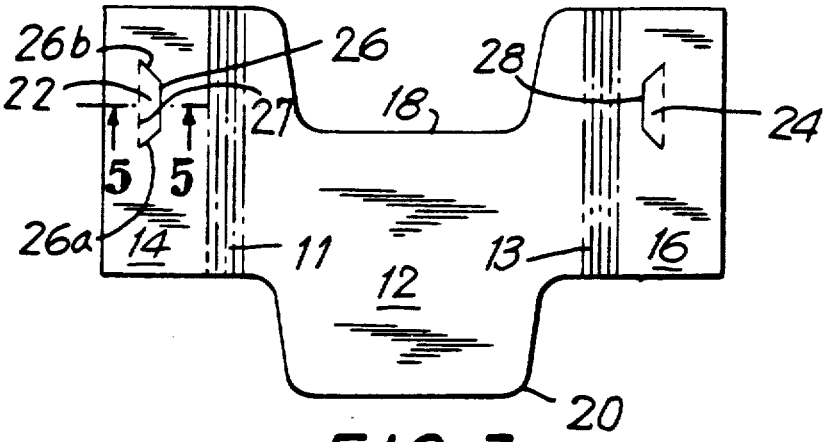
FIG. 3 is a plan view of an innerframe blank used to form the innerframe shown in FIGS. 1 and 2.

Innerframe blank 110 from which innerframe 10 is formed is shown in FIG. 3. Similar reference numbers are used in FIGS. 3–6 for elements which are similar or related to innerframe elements described above. Innerframe blank 110 includes a front panel 12, a left side panel 14, and a right side panel 16, similar to those seen in FIG. 2. The central upper portion of front panel 12 has a cutout portion or depression 18 to facilitate consumer access to the upper ends of the cigarettes which will be in the pack. The central lower portion of front panel 12 has an extension 20, similar in shape to the negative space formed by the cutout portion 18. It will be noted that cutout portion 18 and extension 20 are designed to permit continuous cutoff of innerframes from a roll of material without leaving scrap or waste. Left panel 14 of innerframe blank 110 has a retention member 22 formed by retention cut 26. Right panel 16 of innerframe blank 110 has a retention member 24 formed by retention cut 28. Retention cuts 26 and 28 are preferably die cuts. Front panel 12 is separated from side panels 14 and 16 by a plurality of parallel scores along vertical edges 11 and 13, respectively. Such a multiplicity of scores provides for a multiplicity of vertical edges to be folded along when folding the innerframe to fit into outer member lower main portion 40, hence forming rounded/radiused vertical edges. A similar method of forming similar vertical edges may be used for outer member lower main portion 40 and outer member lid 50.

Figure 4:
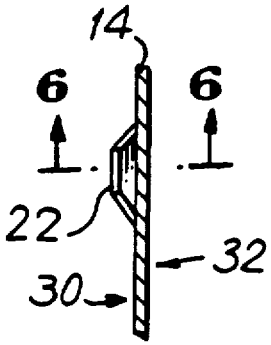
FIG. 4 is a sectional view along line 4—4 of FIG. 2 after the retention means has been pushed out from the plane of the innerframe blank.

A side view of retention member 22 is shown in FIG. 4, which is also representative of similarly formed retention member 24. Retention member 22 is shown projecting outwardly of the outer surface 30 of left side panel 14, into a plane substantially parallel to but spaced from the plane of left side panel 14. It will be understood that retention member 24 similarly projects outwardly of the outer surface 30 of right side panel 16, into a plane substantially parallel to but spaced from the plane of right side panel 16. Retention members 22 and 24 thus add width to innerframe 10 to provide additional pressure to the inside of lid 50 to prevent lid 50 from beginning to open accidentally.

Figure 5:
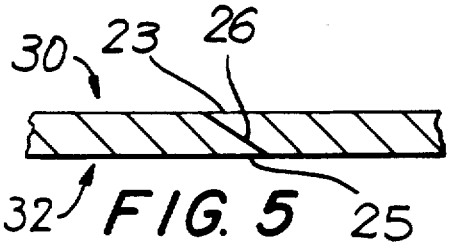
FIG. 5 is a sectional view along line 5—5 of FIG. 3 before the retention means has been pushed out from the plane of the innerframe blank.
Figure 6:
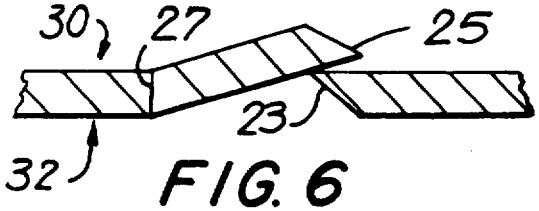
FIG. 6 is a sectional view along line 6—6 of FIG. 4, similar to FIG. 5 but after the retention means has been pushed out from the plane of the innerframe blank.

The formation and positioning of retention members 22 and 24 is more easily understood through examination of FIGS. 5 and 6, which again show representative retention member 22. As shown in FIG. 5, retention cut 26 is at an angle to the plane of the blank such that the edges thereby formed in the blank have oppositely directed pointed edges 23 and 25 adjacent opposite faces of the blank. Retention cuts **26*a* and 26*b* may be made in the blank and at an angle to cut 26 to form a preferably trapezoidal tab-like retention member. Cuts 26, 26*a*, and 26*b* may be considered, together, to form a single retention cut. Sections/cuts 26*a* and 26*b* are preferably cut perpendicular to the plane of the blank, but, alternatively, may be cut at an angle to the plane of the blank, like cut 26. As shown in FIG. 6, the retention member thus formed is subsequently forced to fold or deflect along line 27 until pointed edge 25 is pushed past pointed edge 23 and rests on the outer surface 30 of the blank, adjacent pointed edge 23. Pointed edge 23 holds pointed edge 25 in place resting on outer surface 30 such that the retention member thus formed is prevented from returning to its initial position flush with the outer surface 30 of the blank. It will be understood that retention cut 28 of retention member 24 is formed similarly to retention cut 26. Retention member 24 thus may be prevented from returning to its initial position flush with the outer surface 30 of the blank as retention member 22** is.

Figure 7:
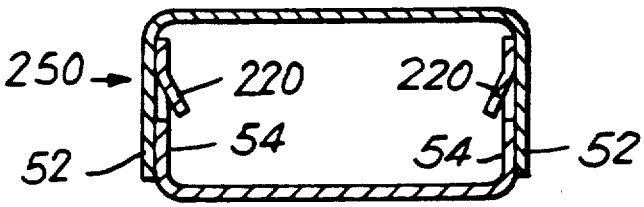
FIG. 7 is a top sectional view through an embodiment of a lid member in accordance with this invention.

As shown in FIG. 7, an alternative location for retention members formed in accordance with this invention is inside outer member lid 250 where the retention members can contact the innerframe (not shown in FIG. 7). Each side wall of lid 250 is formed from an exterior lid side panel 52 and an interior lid side panel 54. A retention member 220 preferably is formed in each interior lid side panel 54, in a similar manner as retention members 22 and 24. Each retention member 220 provides similar interference between the lid and innerframe of the pack as members 22 and 24 provide, thus obviating the need for retention members 22 and 24, if desired.

Although vertical edges 11, 13, 41, 43, 45, 47, 51, 53, 55, and 57 are shown as rounded/radiused, any or all may alternatively be formed as right angled edges.

Although retention members 22 and 24 are shown in the preferred embodiment as being cut in a generally trapezoidal shape, it will be understood that retention members 22 and 24 may be formed in any other convenient shape, such as a semicircle, a rectangle, a triangle, etc. Furthermore, any desired number of retention members may be provided.

Although innerframe 10 of the preferred embodiment is formed from blank 110, separate from the blank from which outer member lower main portion 40 is formed, innerframe 10 and outer member lower main portion 40 may be formed from the same blank. Accordingly, innerframe 10 may be part of the blank from which outer member lower main portion 40 is formed and is folded inside when the blank is formed into a cigarette pack.

Although outer member lid 50 of the preferred embodiment is formed from the same blank as outer member lower main portion 40 and hinged to portion 40, lid 50 need not be formed from the same blank as lower main portion 40. Lid 50 may alternatively be fixed (e.g., with glue) to lower main portion 40 by a member such as a tab. Furthermore, lid 50 need not be joined to outer member lower main portion 40 and alternatively may slide on and off over the innerframe rather than pivoting open and closed along a point of attachment. In the event that lid 50 slides on and off, retention members can be located elsewhere than on the sides of the pack. In particular, they may alternatively or in addition be located on the front and or back of the pack.

It will be understood that the foregoing is merely illustrative of the principles of the invention, and that various modifications can be made by those skilled in the art without departing from the scope and spirit of the invention. For example, the principles of this invention can be applied to cigarette packs of any size (e.g., packs of 10, 14, 20, 25, etc., cigarettes).

What is claimed is:

1. A cigarette pack adapted to contain a plurality of cigarettes, said cigarette pack comprising:

a substantially box shaped outer member lower main portion having at least four vertical walls and a bottom wall;

an innerframe member partly inside at least an upper portion of said outer member and having an innerframe front wall, an innerframe left side wall, and an innerframe right side wall, each said wall having an inner surface facing the inside of the pack and an outer surface facing outwardly from the pack; wherein at least a portion of said innerframe member extends above said outer member; and wherein at least one retention cut is made along at least one of said innerframe walls in said portion extending above said outer member and spaced from the boundaries of said at least one innerframe wall to form at least one tab-like retention member within the boundaries of said at least one innerframe wall; said retention cut made such that at least a portion of the edge of said at least one retention member formed by said cut and the corresponding portion of the edge left in said at least one innerframe wall are configured such that once said retention member is pushed partly out of the surrounding plane of the innerframe, said edges interfere with one another and thereby prevent said retention member from returning to said plane; and an outer member lid member having at least four vertical walls and a top wall and which fits over the portion of said innerframe member which projects above said outer member lower main portion and which closes said pack when said lid member is closed;

wherein said at least one retention member provides pressure to the inside of said lid member to keep said lid from beginning to open.

2. The cigarette pack defined in claim wherein said at least one retention member has edges formed by said retention cut, an inner surface facing the inside of the pack, and an outer surface facing outwardly from the pack; and wherein at least a portion of said retention cut is made at an angle to said at least one wall such that at least a portion of said edges of said at least one retention member forms an obtuse angle with the outer surface of said at least one retention member, and at least a portion of the edges in said at least one wall formed by said at least one retention cut and remaining after said at least one retention member projects outwardly from the plane of said at least one wall forms an acute angle with the outer surface of said at least one wall.

3. The cigarette pack defined in claim 2 wherein said portion of said retention cut further defines a first substantially pointed portion on the edges of said at least one retention member along the inner surface of said at least one retention member, and a second substantially pointed portion on said edges in said at least one wall along the outer surface of said at least one wall; such that said first pointed portion may be pushed past said second pointed portion in order to rest said first pointed portion on said second pointed portion along the outer surface of said at least one wall and thereby project said retention member outwardly from the plane of said at least one wall.

4. The cigarette pack defined in claim 3 wherein said at least one retention cut is a die cut.

5. The cigarette pack defined in claim 3 wherein said at least one retention cut is formed in each of said side walls of said innerframe.

6. The cigarette pack defined in claim 1 wherein said at least one retention cut is formed in each of said side walls of said innerframe.

7. The cigarette pack defined in claim 1 wherein said retention cut is formed along the plane of said at least one wall to form a trapezoidal retention member whose parallel sides are substantially vertical.

8. The cigarette pack defined in claim 1 wherein each of the vertical corners formed by the vertical walls of said outer member lower main portion, the vertical walls of the innerframe and the vertical walls of the lid member are radiused.

9. The cigarette pack defined in claim 8 wherein said outer member lower main portion, said innerframe and said lid member are formed from blanks having multiple parallel score lines joining each of said vertical walls such that the members formed from the respective blanks are formed with said radiused vertical corners where said multiple parallel score lines are situated.

10. The cigarette pack defined in claim 1 wherein the upper central portion of said innerframe front wall has a cutout portion to facilitate consumer access to the cigarettes contained in the pack, and the lower central portion of said innerframe front wall has an extension of substantially the same shape as the negative space formed by said cutout portion, such that said innerframe may be formed from a blank cut from a roll of material from which a plurality of blanks are continuously cut without leaving unused portions between the bottom of one blank and the top of the next blank formed from the material.

11. A cigarette pack adapted to contain a plurality of cigarettes, said cigarette pack comprising:

a substantially box shaped outer member lower main portion having at least four vertical walls and a bottom wall;

an innerframe member partly inside at least an upper portion of said outer member and having an innerframe front wall, an innerframe left side wall, and an innerframe right side wall, each said wall having an inner surface facing the inside of the pack and an outer surface facing outwardly from the pack; wherein at least a portion of said innerframe member extends above said outer member;

an outer member lid member having at least four vertical walls and a top wall and which fits over the portion of said innerframe member which projects above said outer member lower main portion to close said pack, thereby forming an adjacent telescopic relation between said portion of said innerframe walls extending above said outer member and said at least four vertical walls of said outer member lid member;

at least one retention cut made along at least one of said adjacent telescopically related walls and spaced from the boundaries of said at least one wall to form at least one tab-like retention member within the boundaries of said at least one wall; said retention cut made such that at least a portion of the edge of said at least one retention member formed by said cut and the corresponding portion of the edge left in said at least one wall are configured such that once said retention member is pushed partly out of the surrounding plane of the wall, said edges interfere with one another and thereby prevent said retention member from returning to said plane;

wherein said at least one retention member provides interference between said adjacent telescopically related walls.

12. The cigarette pack defined in claim 11 wherein said at least one retention member is formed in at least one of said innerframe walls.

13. The cigarette pack defined in claim 11 wherein said at least four vertical walls of said outer member lid member include a left side wall adjacent said innerframe left side wall and a right side wall adjacent said innerframe right side wall; and wherein said at least one retention member is formed in at least one of said lid member side walls.

* * * * *